United States Patent [19]

Bickos et al.

[11] 4,397,086

[45] Aug. 9, 1983

[54] METHOD OF FABRICATING A SOCKET TYPE ELECTRICAL CONTACT

[75] Inventors: John G. Bickos, Unadilla; Gilbert G. Warren; R. Amelia Piscitelli, both of Sidney, all of N.Y.

[73] Assignee: The Bendix Corporation, Southfield, Mich.

[21] Appl. No.: 228,492

[22] Filed: Jan. 26, 1981

[51] Int. Cl.[3] ..... H01R 43/00

[52] U.S. Cl. ..... 29/876; 29/885; 204/37 R; 339/276 T

[58] Field of Search ..... 29/862, 876, 861, 885; 428/672; 339/276 T, 276 R; 228/209; 204/37 R

[56] References Cited

U.S. PATENT DOCUMENTS

| | | | |
|---|---|---|---|
| 2,816,066 | 12/1957 | Russell | 204/37 R |
| 3,364,064 | 1/1968 | Wijburg | 204/37 R X |
| 3,953,246 | 4/1976 | Wilson et al. | 204/37 R X |
| 4,072,394 | 2/1978 | Waldron et al. . | |
| 4,120,556 | 10/1978 | Waldron et al. . | |
| 4,136,923 | 1/1979 | Spaulding . | |

FOREIGN PATENT DOCUMENTS

| | | | |
|---|---|---|---|
| 515579 | 12/1930 | Fed. Rep. of Germany | 204/37 R |

OTHER PUBLICATIONS

Formed Socket Contact, Qualified to MIL-C-39029, by D. O. Gallusser in Conf. 11th Annual Connector Symp. Proc., Cherry Hill, N.J. 10/1978, pp. 226-236.

*Primary Examiner*—Lowell A. Larson
*Assistant Examiner*—Carl J. Arbes
*Attorney, Agent, or Firm*—Raymond J. Eifler

[57] ABSTRACT

A method of making a gold plated socket contact characterized by heat treating in a vacuum furnace the previously formed and partially gold plated inner sleeve (10) of a three piece contact assembly.

4 Claims, 6 Drawing Figures

METHOD OF FABRICATING A SOCKET TYPE ELECTRICAL CONTACT

This invention relates to electrical connectors and more particularly to a method of gold plating the electrical contact assembly in the connector.

Electrical connectors generally comprise a shell or housing; a plurality of gold plated contacts, each of which are connected to separate incoming wires; and a dielectric insert assembly for fixedly or removably mounting the electrical contacts in the connector shell. In an attempt to reduce the size and cost of electrical connectors, the contacts which formerly were machined are being replaced with less expensive electrical contacts stamped and formed from a sheet of metal. Examples of such stamped and formed contacts may be found in U.S. Pat. Nos. 4,072,394 entitled "Electrical Contact Assembly" issued Feb. 7, 1978; 4,120,556 entitled "Electrical Contact Assembly" issued Oct. 17, 1978; and 4,136,923 entitled "Unitary Hooded Electrical Contact" issued Jan. 30, 1979. In electrical connectors used in the Aerospace field, it is very important that the contacts be protected from the environment; and that when the electrical contact is mated with another contact that the voltage drop across the mated contacts be as low as possible. In both instances, plating the contact with gold will minimize the resistance drop between contacts and protect the mated contacts from their environment. Presently, stamped and formed contacts are made by stamping the contact from a sheet of metal forming it into the desired shape, heat treating it to obtain the required resiliency, and then plating the entire contact with 0.630 to 1.25 micrometers of gold. This thickness of gold is required to prevent the gold from wearing off during use which would cause the loss of environmental protection and increase the resistance (voltage drop) between the mated contacts 200–300%. Now, gold has become very expensive thereby raising the cost to manufacture the contacts and connector.

Disclosure of the Invention

This invention is a method of gold plating a socket-type contact that utilizes less gold than has been required in the past. The invention is characterized by heat treating in a vacuum furnace a formed contact having a gold band on the inside mating surface portion of the contact.

Accordingly, it is an advantage of this invention to provide a socket-type contact for use in electrical connectors that uses less gold than prior art contacts to achieve the same low voltage drop when mated with another contact.

DETAILED DESCRIPTION OF THE INVENTION

Figure 1:
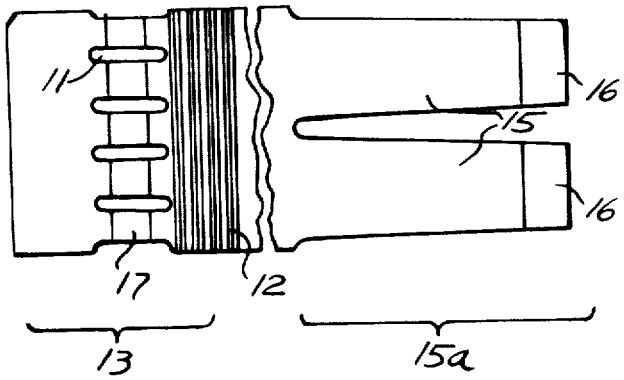
FIG. 1 illustrates a flat piece of metal stamped to a particular configuration.

Referring now to the drawings, FIG. 1 illustrates a flat piece of metal that has been stamped from a piece of metal, such as beryllium copper which has been plated with nickel. The flat piece includes a plurality of slots 11 arranged in the rear portion 13 to provide structural uniformity of the metal when a wire is crimped to the finished contact; a plurality of radial grooves 12 for retaining the wire when inserted in the completely formed contact and minimizing axial movement of the wire after crimping; and a pair of fingers 15 at the forward mating portion **15*a* of the contact. A band of gold 16 is located on one side of the fingers 15. When the contact is completely formed, the band of gold 16 will provide a low resistance contacting surface with a pin-type contact (not shown). A second band of gold 17** may also be placed on one side of the stamping to provide less resistance between an incoming wire crimped to the completely formed contact. The gold may be plated onto the nickel coating by mechanical bonding (rolling), electrochemical deposition (the preferred method) or vapor deposition.

Figure 2:
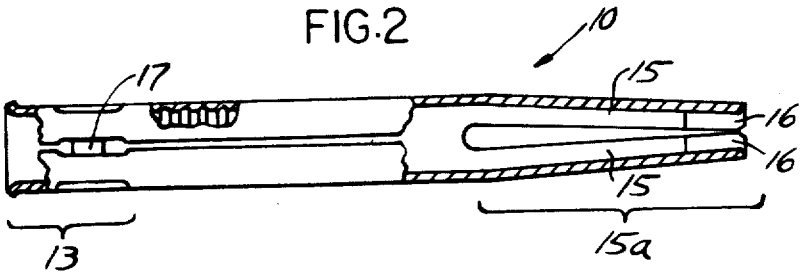
FIG. 2 illustrates the metal of FIG. 1 formed into a tubular socket contact.

FIG. 2 shows the sheet of metal shown in FIG. 1 formed into the tubular shape of an inner sleeve for a socket contact. After the inner sleeve has been formed, it is heat treated for two hours and 30 minutes (plus or minus 15 minutes) in a vacuum furnace at a temperature of 489 degrees centigrade. The maximum pressure in the vacuum furnace is 50 microns. Alternately, heat treating may be accomplished by heating to the same temperature (not in a vacuum) but in a reducing atmosphere or in a dry inert atmosphere. The heat treating of the base metal, i.e., beryllium copper hardens the base metal to provide the spring characteristics necessary to make the fingers 15 resiliently and radially deflectable.

Figure 3:
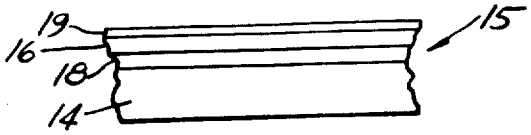
FIG. 3 is a cross sectional view of one of the fingers.

FIG. 3 illustrates a cross section of the gold plated portion of the finger 15. The beryllium copper base metal 14 has a coating of nickel 18, a first coating of gold 16 about 0.625 to 1.25 micrometers thick, and, if desired for environmental protection a second coating of gold 19 less than 0.250 micrometers thick. Accordingly, the thickness of gold, will be the greatest at the point where wear is the greatest, i.e., always more than 0.625 micrometers at the end portion of the fingers 15 which provides a thickness that will not be worn away in normal use.

Figure 5:
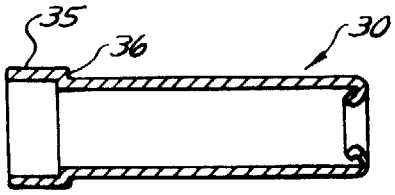
FIGS. 4 and 5 illustrates additional sleeves placed over the socket contact shown in FIG. 2.
Figure 4:
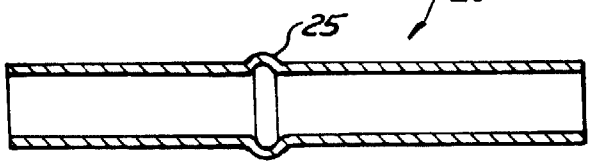

FIGS. 4 and 5 illustrates an intermediate sleeve 20 with an enlarged middle portion 25, and an outer sleeve 30 that has an enlarged end portion 35 with a forwardly facing shoulder 36. The enlarged portion 35 and the forward facing shoulder 36 being necessary to retain the contact in an insert (not shown) of a connector. Alternately, as is shown in U.S. Pat. No. 4,072,394, separate sleeves may be placed over only the front portion and rear portion of the inner sleeve to provide mechanical strength.

Figure 6:
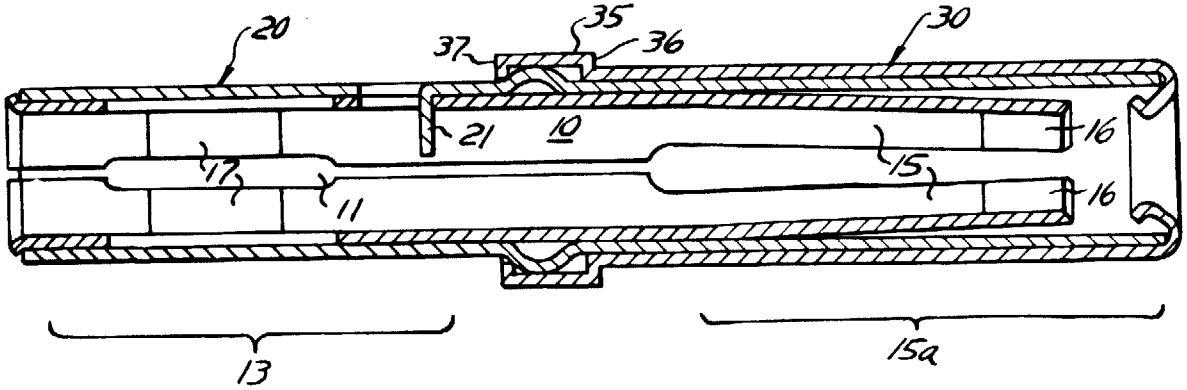
FIG. 6 shows an electrical socket contact embodying the principles of this invention.

FIG. 6 illustrates a completed electrical socket-type contact assembly for use in an electrical connector. The intermediate sleeve 20 is telescopically mounted to the inner sleeve 10. A finger 21 is pressed through the inner sleeve 10 to provide a wire inspection hole. The intermediate sleeve 20 includes an enlarged portion 25 in the middle that is used to locate the outer sleeve 30. The outer sleeve 30, which protects the forward mating portion of the inner sleeve 10, is retained on the intermediate sleeve 20 by forming a rear shoulder 37 to captivate the enlarged portion 25 of the intermediate sleeve between shoulders 37 and 36. The rear wire receiving portion 13 of the socket contact assembly may include a second gold band 17 and the slots 11 which assist in providing uniform deformation when a wire (not shown) is inserted into the inner sleeve 10 and crimped to the socket contact assembly.

The forward mating portion 15*a* of the socket assembly includes the outer sleeve 30 which protects the more fragile resiliently deflectable fingers 15 which are adapted to engage a pin-type contact (not shown) upon mating with another electrical connector assembly.

While a preferred embodiment of this invention has been disclosed, it will be apparent to those skilled in the art that changes may be made to the invention as set forth in the appended claims, and in some instances, certain features of the invention may be used to advantage without corresponding use of other features. For instance, in some applications plating the entire contact with gold for environmental protection may not be necessary and therefore only a single band of gold on the inside portion of the mating fingers would be used. Accordingly, it is intended that the illustrative and descriptive materials herein be used to illustrate the principles of the invention and not to limit the scope thereof.

Having described the invention, what is claimed is:

1. A method of fabricating a socket type electrical contact for use in an electrical connector comprising the steps of:

plating a strip of beryllium copper with nickel;

plating only one end portion of one side of said strip with a first layer of gold to a thickness of at least 0.625 micrometers;

stamping, from said sheet a rectangularly shaped piece having a plurality of fingers extending longitudinally from one end of said piece;

forming said rectangular piece into a tubular form;

heating said tubular form in a vacuum furnace at a pressure below 50 microns for at least 2 hours and 15 mintues at a temperature of about 489 degrees centigrade; and plating the entire tubular form with a second layer of gold to a thickness less than 0.250 micrometers.

2. The method as recited in claim 1 including the steps of:

placing an intermediate sleeve over said tubular form; and placing an outer sleeve over a portion of the intermediate sleeve that surrounds the plurality of fingers.

3. The method as recited in claims 1 or 2 wherein the first layer of gold comprises a band along each end portion of said strip.

4. The method as recited in claim 1 including the steps of:

placing a sleeve over the portion of the tubular form having the fingers; and placing another sleeve over the opposite end portion of said tubular form.

* * * * *